US005740504A

United States Patent [19]

Akinaga et al.

[11] Patent Number: 5,740,504

[45] Date of Patent: Apr. 14, 1998

[54] ELECTROPHOTOGRAPHING METHOD USING CARONA CHARGING DEVICE HAVING AREAS WITH AND WITHOUT A GRID

[75] Inventors: Katsuhiro Akinaga; Hirofumi Ouchi; Kaoru Kataoka, all of Ibaraki, Japan

[73] Assignee: Hitachi Koki Co., Ltd., Tokyo, Japan

[21] Appl. No.: 653,299

[22] Filed: May 24, 1996

[30] Foreign Application Priority Data

May 26, 1995 [JP] Japan ..... 7-127720

[51] Int. Cl.[6] ..... G03G 15/02

[52] U.S. Cl. ..... 399/171; 250/324; 399/50

[58] Field of Search ..... 399/50, 167, 169, 399/170, 171, 178; 361/225; 250/324, 325

[56] References Cited

U.S. PATENT DOCUMENTS

| | | | |
|---|---|---|---|
| 4,456,365 | 6/1984 | Yuasa | 399/171 |
| 4,480,909 | 11/1984 | Tsuchiya | 399/50 |
| 5,136,372 | 8/1992 | Nakatani et al. | 399/178 X |
| 5,452,061 | 9/1995 | Kojima et al. | 399/171 |

FOREIGN PATENT DOCUMENTS

| | | |
|---|---|---|
| 0666515A2 | 8/1995 | European Pat. Off. . |
| 3403303A1 | 8/1984 | Germany . |
| 3715683A1 | 11/1987 | Germany . |
| 3723254A1 | 1/1988 | Germany . |
| 3806589A1 | 11/1988 | Germany . |
| 4007848A1 | 10/1990 | Germany . |

*Primary Examiner*—Sandra L. Brase

*Attorney, Agent, or Firm*—Sughrue, Mion, Zinn, Macpeak & Seas, PLLC

[57] ABSTRACT

An electrophotographing method using a corona charging device having areas with and without a grid. Prior to at least a second exposure step, a charging step is effected using both areas relative to the grid. A voltage applied to the grid in the second charging is lower than that in the first charging, and lower than a potential of a non-image region of the photosensitive body.

4 Claims, 6 Drawing Sheets

ELECTROPHOTOGRAPHING METHOD USING CARONA CHARGING DEVICE HAVING AREAS WITH AND WITHOUT A GRID

BACKGROUND OF THE INVENTION

1. Field of the Invention

The present invention relates to an electrophotographing method, and more particularly to an electrophotographing method for recording and forming two or more color toner images.

2. Description of the Related Art

Referring to FIGS. 1 to 4, an explanation will be given of the prior art. FIGS. 1 and 2 are explanation views each showing the schematic structure of an electrophotographic device for recording and forming two color toner images by rotating a photosensitive body twice. FIG. 3 is an explanation view showing a corona charging means. FIG. 4 is an explanation view showing potential levels of the photosensitive body in the process of the electrophotographic device shown in FIG. 4.

In FIG. 1, a photosensitive body 1 is uniformly charged by a charger 2. The potential at this time is referred to as $V_0$1 as shown in FIG. 4. Light exposure corresponding to the first color image is effected by light-exposure means 3. Then, the potential at a light-exposure portion is attenuated to Vr1 as shown in FIG. 4. Thereafter, using a two-component developer, the first color toner image is formed by a developing device 4 to which a developing bias voltage Vb1 is applied by a high voltage power source 41. The potential at the area where the first toner image is formed rises to Vi1 because of application of the first color toners with charges.

When the first color toner image is formed on the photosensitive body, in order that it is not disturbed, a second-color developing device 5, a transfer device 6 and a cleaning device 8 are separated from the surface of the photosensitive body 1.

The second charging is carried out by the charger 2. When the second color toner image is formed, in order to prevent the second color toners from being applied to the first color toner image formed previously, the potential of the first color toner image is raised. Then, the potentials of the first color toner image and non-image area become Vir and $V_0$2, respectively. Light exposure corresponding to the second color image is effected by the light exposure means 3. At this time also, the potential at the light exposure area is attenuated to Vr2 as shown in FIG. 4. Thereafter, in order that the first color toner image formed on the photosensitive body 1 is not disturbed, the developing device 4 for the first color is separated from the photosensitive body 1. The developing device 5 to which a developing voltage Vb2 is applied by the high voltage power source 51 is caused to approach the photosensitive body 1. Using e.g. a two-component developer, the second color toner image is formed by the developing device 5. Then, as shown in FIG. 4, the potential at the area where the second toner image is formed rises to Vi2 because of application of the second color toners with charges.

The two-color toner image formed on the photosensitive body 1 is transferred from the photosensitive body 1 to a sheet of paper 9 by a transfer device 6 in contact with the photosensitive body 1 and fixed thereon by a fixing device 7. The toners left on the photosensitive body 1 are removed from the photosensitive body 1 by the cleaning device 8. Thus, one cycle of electrophotography is completed.

In the above prior art, after the second charging, if the potential Vir of the area where the first color toner image is formed is too high compared to the developing bias voltage Vb2 used to develop the second color toner image, the first color toners would be mixed into the second color developer because of the electric field of Vir–Vb2, thus deteriorating the image density of the first color and smearing the second color image. Further, if the potential Vir of the area where the first color toner image is formed is too low compared to the developing bias voltage Vb2, the second color toners are developed into the area on which the first color toner by the electric field of Vb2–Vir, thus smearing the first color toner image.

As a method for solving such a problem, the potential difference of Vir–Vb2 can be decreased during the second color development. This method can provide improved two-color image free from the color-overlapping smear of the first color or the color-mixing smear of the second color. However, because of the electric field created by a boundary potential difference between the image area and the non-image area, i.e. edge effect, the second color toners are developed around the first color toner image. As a result, poor printing quality occurs such that a printed sample looks as if the first color toner image is edged in its outer periphery by the second color toner. This is commonly called "fringe phenomenon".

SUMMARY OF THE INVENTION

The present invention has been made in view of the above, and therefore an object of the invention is to provide an electrophotographing method which is capable of recording a good multi-color toner image free from a fringe phenomenon.

The above object can be attained, in an electrophotographing method in which steps of charging, light exposure and development for a photosensitive body are repeated plural times to form plural toner images thereon, by providing a corona charging means used for the charging step with an area with no grid and another area with a grid, and prior to at least the second exposure step, effecting the charging step using both areas relative to the grid.

In accordance with the electrophotographing method according to the present invention, the area with no grid in the corona charging means raises the potential at the lower potential portion at the boundary or edge between the lower potential portion such as an image portion and the higher potential portion such as an non-image portion, thus decreasing the potential difference at the edge to reduce the edge effect. The area with the grid, where there is the higher potential portion such as the non-image portion having a higher potential than a grid voltage and the lower potential portion such as the image portion having a lower potential than the grid voltage, raises the potential at the lower potential portion, thus uniformly charging the photosensitive body by the effect of the presence of the grid. Thus, using both the areas with no grid and with a grid can provide a good toner image free from the fringe phenomenon.

BRIEF DESCRIPTION OF THE DRAWINGS

The above and other objects and features of the present invention will be more apparent from the following description taken in conjunction with the accompanying drawings.

DETAILED DESCRIPTION OF THE PREFERRED EMBODIMENTS

Now, a description will be given of embodiments of the present invention with reference to the accompanying drawings.

Figure 5:
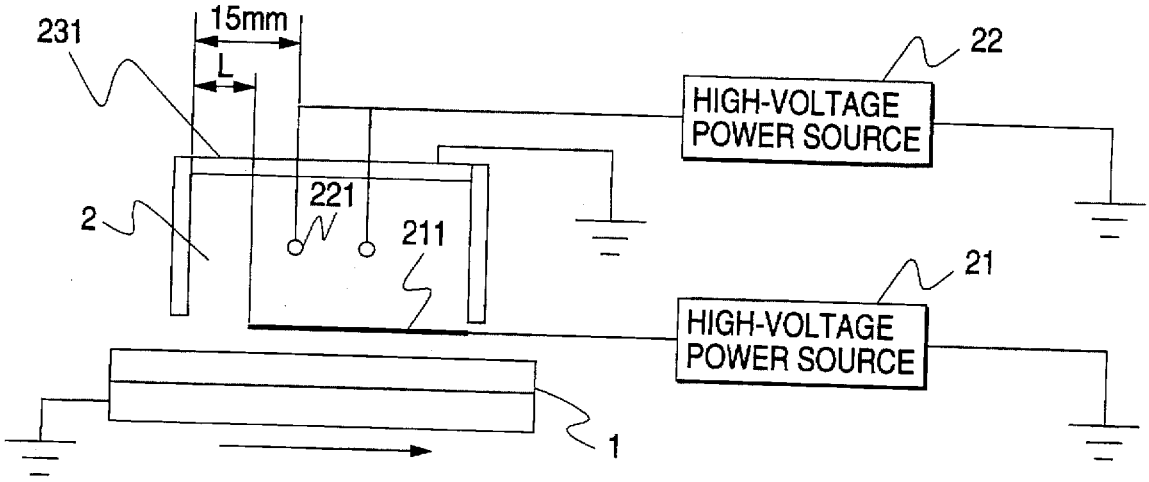
FIG. 5 is a schematic structural view showing the charger according to the present invention.

Referring to the drawings, an explanation will be given of one embodiment of the present invention. In accordance with the present invention, a corona charger 2 used in a charging step has an area with a grid and another area with no grid. The charger according to the present invention is shown in FIG. 5. As seen from the figure, below a metal plate 231 connected to ground, metal wires each having a diameter of 60–100 μm is arranged as corona wires 221 through which a current of 500–600 μA is passed by a high voltage power supply 22 for constant current control. Between the corona wires 221 and a photosensitive body 1, plural metal wires each having a diameter of about 0.1 mm are arranged at a pitch of about 1 mm as grid wires 211. No grid wire is partially arranged on the upstream side in a moving direction of the photosensitive body. To the grid wires 211, a voltage, having a value varying between the first charging step and the second et seq. charging step, is applied by a high voltage power supply 21 for constant voltage control.

Figure 1:
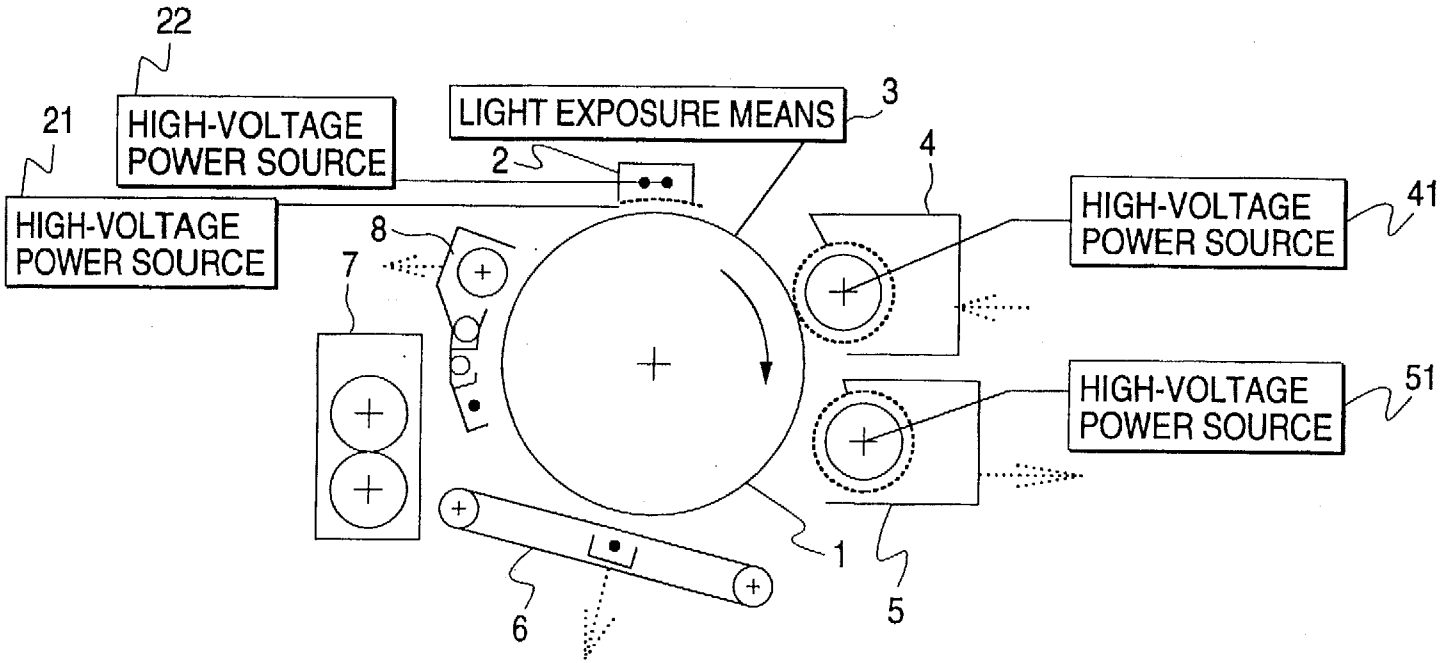
FIG. 1 PRIOR ART
FIG. 1 is an explanation view showing the configuration of a common electrophotographic device.
Figure 2:
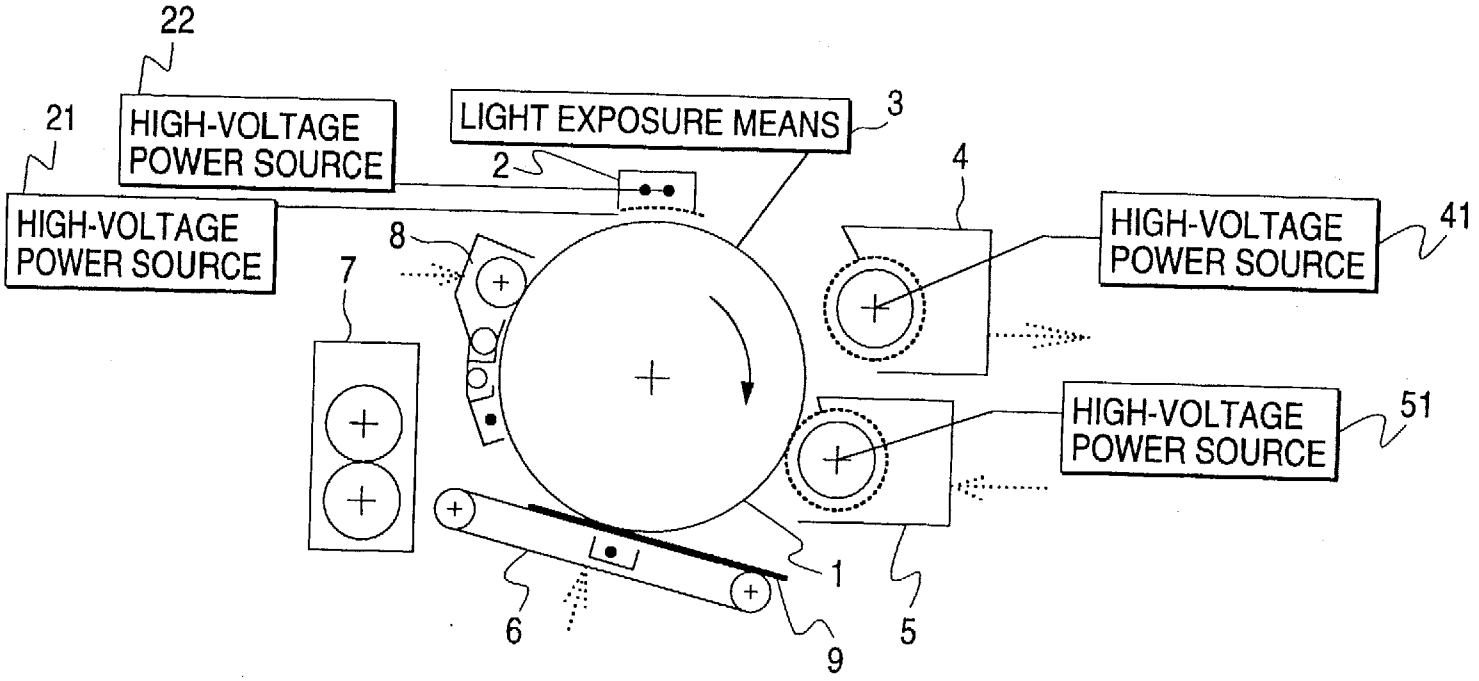
FIG. 2 PRIOR ART
FIG. 2 is an explanation view showing the configuration of a common electrophotographic device.
Figure 3:
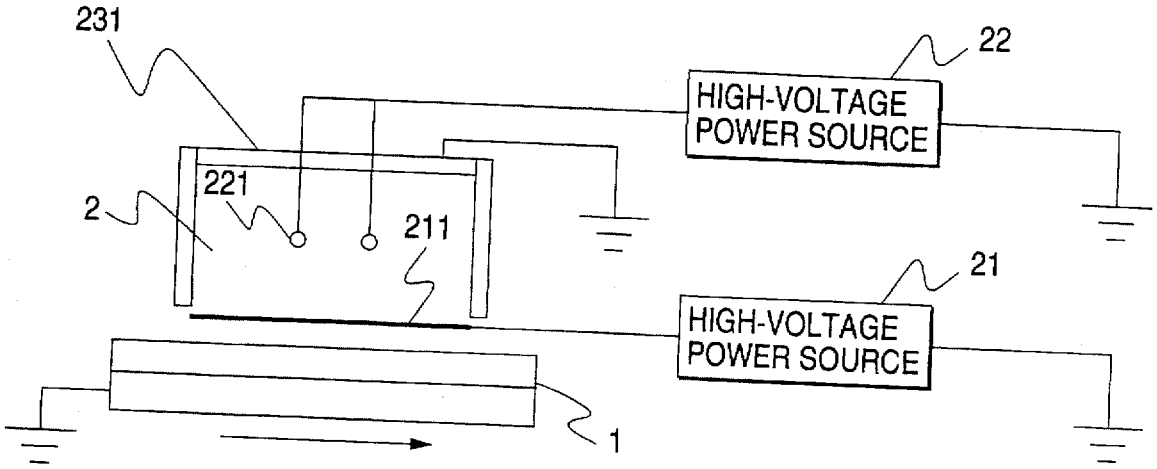
FIG. 3 PRIOR ART
FIG. 3 is a schematic structural view of a conventional charger.
Figure 4:
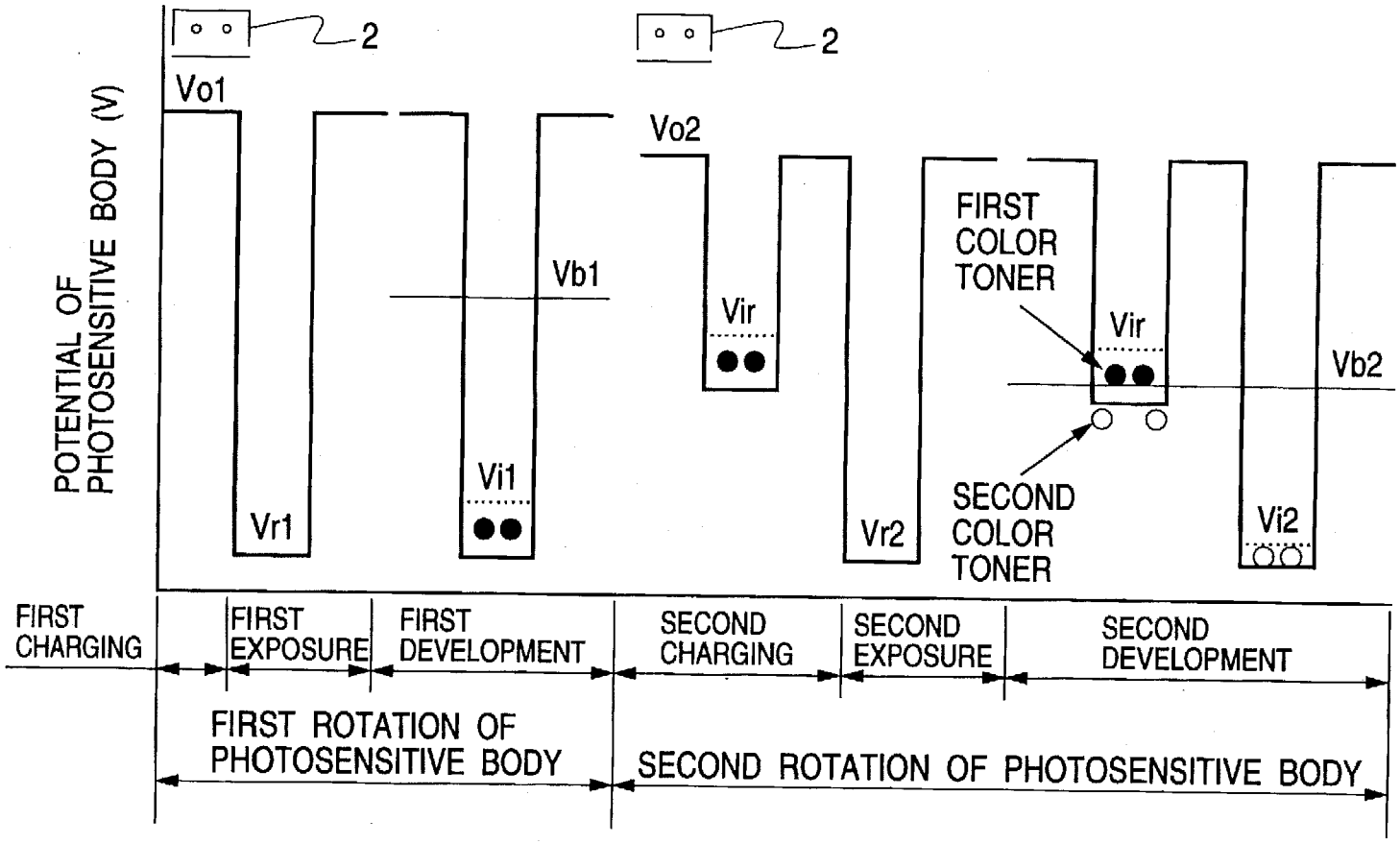
FIG. 4 is a view explanatorily showing the potential level on a photosensitive body.

Referring to FIGS. 1, 2 and 4, an explanation will be given of a process of recording a multi-color toner image using the corona charger 2 thus constructed. An OPC is used as the photosensitive body 1. In the first charging step, the photosensitive body 1 is uniformly charged by the charger 2 with an applied grid voltage of about −600 V so that the surface potential $V_0$1 of the photosensitive body 1 becomes about −650 V. Subsequently, light exposure corresponding to the first color image is effected by the light exposure means 3 to form a latent image. Then, the potential Vr1 at a light exposure area is attenuated to about −50 V. Thereafter, inverting development is effected by the developing device 4 having a two-component developer containing the first color toners. The developing bias voltage applied to the developing device 4 is about −400 V. Thus, the first color toner image is formed on the photosensitive body 1 and the potential Vi1 at a developing area reaches about −120 V. With the passage of time to the second charging step, the potential at the photosensitive body 1 is attenuated. As a result, the potential at the non-image region reaches about −600 V and that at the image region reaches about −100 V.

In the second charging, a current of about −550 μA which is approximately equal to the current adopted in the first charging is passed through the corona wires 221. To the grid wires 211, a voltage (about −250 V) lower than in the first charging is applied. Then, a part of corona ions generated in the area with no grid due to corona discharge of the corona wires 221 uniformly flows onto the photosensitive body 1, thus boosting the potentials at the first color image region and non-image region. Particularly, corona ions flow onto the edge between the image region and the non-image region to boost the potential there. The potentials at the image region and non-image region are about −250 V and about −650 V, respectively. On the other hand, in the area with the grid, the corona ions from the corona wires 221 do not reach the nonimage region of the photosensitive body 1 which is at a potential higher than the grid voltage, but flow to the image portion which is at the potential equal or lower than the grid voltage, with the result that only the potential at the image region is uniformly boosted by controllability of the grid wires 211. Thus, the potential Vir at the image region reaches about −350 V and the potential $V_0$2 at the non-image region reaches about −650 V.

Subsequently, light exposure corresponding to the second color image is effected by the light exposure means 3 to form a latent image. Then, the potential Vr2 at an light exposure area is attenuated to about −50 V. Thereafter, inverting development is effected by the developing device 4 having a two-component developer containing the second color toners. The bias voltage applied to the developing device is about −300 V. Thus, the second color toner image is formed on the photosensitive body 1, and because of application of the toners, the potential Vil at a developing area rises to about −100 V. The two-color toner image formed on the photosensitive body 1 is transferred to a sheet of paper by the transfer device 6, and fixed thereon by the fixing device 7. The toners left on the photosensitive body 1 are removed therefrom by the cleaning device 8, thus completing one cycle of electrophotography.

In this embodiment, two corona wires are provided, but the present invention is not limited to the number of corona wires.

Further, in this embodiment, a single charger has the area with no grid and the area with the grid. But, for example, a "corotron" serving as the area with no grid and a "scorotron" serving as the area with the grid may be provided adjacently to each other, thus giving the same effect as this embodiment.

Further, in this embodiment, the same charger is used in both the first charging step and the second charging step, but the charger according to the present invention may be used for only the second charging step.

In this embodiment, the area with no grid is located at the end of the grid, but it may be centrally located in the grid to provide the same effect.

Figure 6:
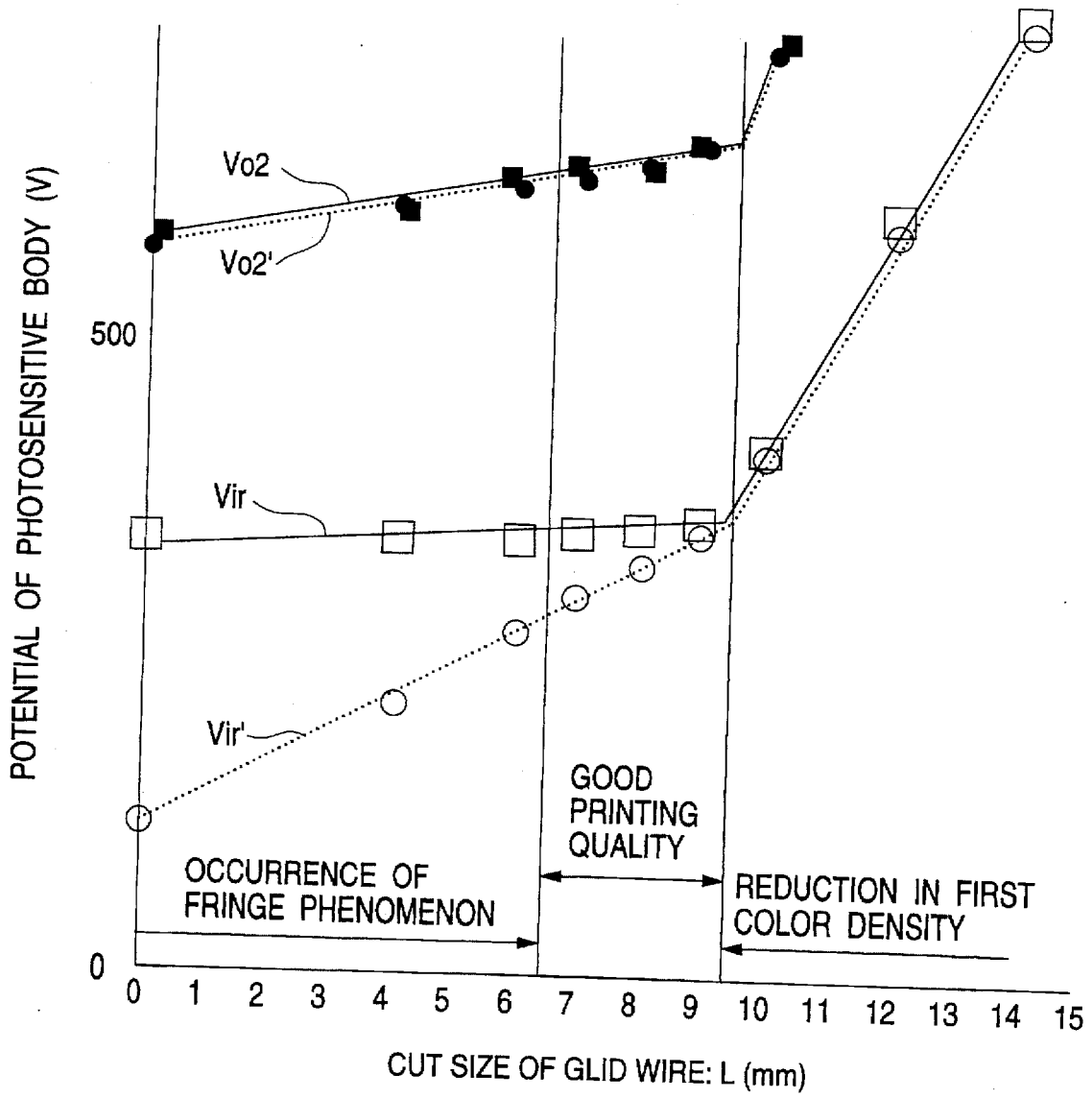
FIG. 6 is a graph showing a relationship between the potentials on the photosensitive body and a grid wire cutting size.

Referring to FIGS. 5 and 6, an explanation will be given of an experimental result for the charger according to the present invention. In an experiment, as seen from FIG. 5, an endmost one of the corona wires 221 is separated by 15 mm from the end of the charger 2. FIG. 6 is a graph showing the potentials of the photosensitive body (ordinate) and the cut size L of the grid wire that corresponds to the size of the area with no grid from the end of the charger (abscissa). Specifically, FIG. 6 shows a relationship between L and Vir (i.e. the potential at the image region after the second charging step) and $V_0$2 (the potential at the non-image region after the second charging step). In FIG. 6, white and black circles represent the potential Vir' at the image portion Vir' and the potential $V_0$2' at the non-image portion after the charging step due to only the area with no grid, respectively, and white and black squares represent the potential Vir at the image region and the potential $V_0$2 at the non-image region after the charging step by both the areas with no grid and with the grid, respectively. As seen from the figure, in the range from L=0, that is a condition in the conventional charger having only the area with no grid cut, to L=6 mm, the fringe phenomenon occurs, thus resulting in poor printing quality. In this range, the charger of the area with no grid does not raise the potential Vir' at the image region so greatly that a small quantity of corona is discharged.

On the other hand, in the range of the grid cut size of L=10 mm or more, the density of the first color is attenuated, resulting in poor printing quality. In this range, the area with no grid of the charger raises the potential Vir' so greatly that Vir' becomes equal to the final development potential Vir. Thus, the charging control effect by the grid does not function, thereby giving a change in the potential at the image portion. This means that too large a quantity of corona is discharged in the area with no grid. Now, under the above condition of experiment, setting the cut size of the grid for L=7–9 mm could provide good printing quality free from the fringe phenomenon and attenuation in the first color density. It should be noted that the desired size of L depends on several conditions for the charger.

As described above, in accordance with the electrophotographing method according to the present invention, multi-color recording with no fringe phenomenon can be realized.

The foregoing description of a preferred embodiment of the invention has been presented for purposes of illustration and description. It is not intended to be exhaustive or to limit the invention to the precise form disclosed, and modifications and variations are possible in light of the above teachings or may be acquired from practice of the invention. The embodiment was chosen and described in order to explain the principles of the invention and its practical application to enable one skilled in the art to utilize the invention in various embodiments and with various modifications as are suited to the particular use contemplated. It is intended that the scope of the invention be defined by the claims appended hereto, and their equivalents.

What is claimed is:

1. An electrophotographing method, comprising the steps of:

charging a photosensitive body;

exposing a light on the photosensitive body;

developing an image on the photosensitive body;

repeating said charging step, said exposing step and said developing step plural times to form a plurality of toner images on the photosensitive body;

wherein said charging step is performed using a corona charging device having an area with no grid and another area with a grid, and prior to at least a second exposing step, said charging step is effected using both areas relative to the grid, and wherein a voltage applied to the grid in the second charging is lower than a voltage applied in the first charging.

2. An electrophotographing method according to claim 1, wherein a corotron serves as the area with no grid and a scorotron serves as the area with the grid, and the corotron and scorotron are adjacent to each other.

3. An electrophotographing method, comprising the steps of:

charging a photosensitive body;

exposing a light on the photosensitive body;

developing an image on the photosensitive body;

repeating said charging step, said exposing step and said developing step plural times to form a plurality of toner images on the photosensitive body;

wherein said charging step is performed using a corona charging device having an area with no grid and another area with a grid, and prior to at least a second exposing step, said charging step is effected using both areas relative to the grid, and wherein a voltage applied to the grid in the second charging is lower than the potential of a non-image region of the photosensitive body.

4. An electrophotographing method as recited in claim 3, wherein the voltage applied to the grid in the second charging is equal to or greater than the potential of an image region of the photosensitive body.

* * * * *